US005906446A

United States Patent [19]

McCulloch et al.

[11] Patent Number: 5,906,446

[45] Date of Patent: May 25, 1999

[54] FILLERLESS WRITING INSTRUMENT

[75] Inventors: Russell McCulloch, Simpsonville; Frank Hart, Jonesville; Ronald Rukan; Barry W. Chadwick, both of Simpsonville, all of S.C.

[73] Assignee: BIC Corporation, Milford, Conn.

[21] Appl. No.: 08/735,230

[22] Filed: Oct. 22, 1996

[51] Int. Cl.[6] ..... B43K 8/04; B43K 8/08

[52] U.S. Cl. ..... 401/199; 401/198

[58] Field of Search ..... 401/198, 199

[56] References Cited

U.S. PATENT DOCUMENTS

| | | | |
|---|---|---|---|
| 3,340,560 | 9/1967 | Nakata . | |
| 3,598,494 | 8/1971 | Bok . | |
| 3,900,268 | 8/1975 | Bok . | |
| 3,947,137 | 3/1976 | Hori . | |
| 3,951,555 | 4/1976 | Wittnebert et al. . | |
| 3,957,379 | 5/1976 | Wittnebert . | |
| 4,239,408 | 12/1980 | Mutschler . | |
| 4,382,707 | 5/1983 | Anderka . | |
| 4,408,921 | 10/1983 | Nagai | 401/198 |
| 4,430,014 | 2/1984 | Tsai . | |
| 4,461,591 | 7/1984 | Mutschler . | |
| 4,522,525 | 6/1985 | Saito et al. . | |
| 4,529,329 | 7/1985 | Hirabayashi et al. . | |
| 4,531,853 | 7/1985 | Hirabayashi et al. . | |
| 4,556,336 | 12/1985 | Sano et al. | 401/199 |
| 4,565,463 | 1/1986 | Otaguro et al. . | |
| 4,572,691 | 2/1986 | Kirchhoff et al. . | |
| 4,634,305 | 1/1987 | Herrnring . | |
| 4,645,367 | 2/1987 | Mutschler et al. . | |
| 4,671,692 | 6/1987 | Inaba . | |
| 4,712,937 | 12/1987 | Schmidt et al. . | |

(List continued on next page.)

FOREIGN PATENT DOCUMENTS

| | | | |
|---|---|---|---|
| 0015310 | 7/1980 | European Pat. Off. . | |
| 0091610 | 10/1983 | European Pat. Off. . | |
| 0256615 | 2/1988 | European Pat. Off. . | |
| 0314893 | 5/1989 | European Pat. Off. . | |
| 469465 | 2/1992 | European Pat. Off. | 401/199 |
| 914582 | 10/1946 | France . | |
| 2569615 | 3/1988 | France . | |
| 2711045 | 4/1995 | France . | |
| 2717423 | 9/1995 | France . | |
| 173131 | 11/1952 | Germany . | |
| 1250302 | 9/1967 | Germany . | |
| 1259733 | 1/1968 | Germany . | |
| 1911951 | 9/1970 | Germany . | |
| 3207219 | 10/1983 | Germany . | |

(List continued on next page.)

*Primary Examiner*—Steven A. Bratlie
*Attorney, Agent, or Firm*—Abelman, Frayne & Schwab

[57] ABSTRACT

A writing instrument is disclosed having a barrel defining an internal passage including an ink reservoir. A venting mechanism is positioned at least partially within the internal passage of the barrel adjacent an anterior end portion thereof. The venting mechanism includes an elongated body defining an axial bore therethrough in communication with the ink reservoir, and a plurality of spaced apart fins peripherally surrounding the elongated body and defining a plurality of annular channels between the fins. Each of the fins defines a groove thereon to interconnect the annular channels. The writing instrument further includes a point support member supporting a writing point and positioned adjacent an anterior end portion of the venting mechanism and defining an axial bore aligned with the axial bore of the venting mechanism. A first ink supply rod is disposed within the axial bore of the venting mechanism and has a posterior end portion in communication with the ink reservoir to convey ink from the ink reservoir to an anterior portion of the venting mechanism. A second supply rod conveys ink from a posterior end portion disposed within the bore in the venting mechanism and contacting the first supply rod to an anterior end portion disposed within the bore of the point support member, to the writing point. A circuitous air path is provided to vent the ink reservoir at the posterior end portion to the writing tip portion.

26 Claims, 3 Drawing Sheets

U.S. PATENT DOCUMENTS

| | | | |
|---|---|---|---|
| 4,728,214 | 3/1988 | Mutschler . | |
| 4,753,546 | 6/1988 | Witz et al. . | |
| 4,761,090 | 8/1988 | Goh . | |
| 4,770,558 | 9/1988 | Frietsch . | |
| 4,930,921 | 6/1990 | Anderka . | |
| 4,938,620 | 7/1990 | Weiss et al. . | |
| 4,954,002 | 9/1990 | Wallis et al. . | |
| 4,968,169 | 11/1990 | Yokosuka et al. . | |
| 4,986,684 | 1/1991 | Yamanaka | 401/224 |
| 5,004,365 | 4/1991 | Felgentreu . | |
| 5,052,841 | 10/1991 | Jozat et al. . | |
| 5,087,144 | 2/1992 | Wada et al. . | |
| 5,102,251 | 4/1992 | Kaufmann | 401/151 |
| 5,154,525 | 10/1992 | Matsuo | 401/209 |
| 5,172,995 | 12/1992 | Felgentreu . | |
| 5,217,313 | 6/1993 | Tamura et al. . | |
| 5,290,117 | 3/1994 | Yokosuka et al. | 401/224 |
| 5,336,009 | 8/1994 | Young . | |
| 5,336,010 | 8/1994 | Shiomitsu | 401/199 |
| 5,352,051 | 10/1994 | Tamura et al. . | |
| 5,372,445 | 12/1994 | Mutschler | 401/225 |
| 5,420,615 | 5/1995 | Witz et al. | 346/140.1 |
| 5,427,463 | 6/1995 | Bastiansen et al. | 401/134 |
| 5,551,789 | 9/1996 | Okawa et al. | 401/199 |
| 5,556,215 | 9/1996 | Hori | 401/199 |
| 5,735,624 | 4/1998 | O'Connor et al. | 401/217 |

FOREIGN PATENT DOCUMENTS

| | | | |
|---|---|---|---|
| 3429031 | 2/1986 | Germany . | |
| 3442331 | 5/1986 | Germany . | |
| 3526578 | 3/1987 | Germany . | |
| 3926271 | 2/1991 | Germany . | |
| 19610644 | 9/1997 | Germany . | |
| 443439 | 12/1948 | Italy . | |
| 57-18295 | 1/1982 | Japan . | |
| 6021260 | 6/1985 | Japan | 401/199 |
| 6127186 | 5/1994 | Japan | 401/199 |
| 6239090 | 8/1994 | Japan | 401/199 |
| 663951 | 1/1952 | United Kingdom . | |
| 2072587 | 10/1981 | United Kingdom . | |
| 2122953 | 1/1984 | United Kingdom . | |
| WO9220530 | 11/1992 | WIPO . | |
| WO9706962 | 2/1997 | WIPO . | |

FILLERLESS WRITING INSTRUMENT

BACKGROUND

1. Technical Field

The present application relates to a writing instrument, and more particularly to a fillerless writing instrument having a venting mechanism.

2. Background of Related Art

Baffle or fin-type venting mechanisms are common to writing instruments. These mechanisms are typically used in fillerless-type writing instruments to prevent ink leakage at varying ambient temperatures. Typically, filler-type writing instruments incorporate a porous filler material for containing the ink supply, whereas fillerless writing instruments incorporate an ink reservoir in combination with an ink transport system to carry the ink from the reservoir to the writing point.

Fillerless writing instruments exhibit several advantages over filler-type writing instruments. These advantages include an improved ink flow over the life of the writing instrument, and a greater utilization of the ink charge. For example, in filler-type writing instruments, often a substantial portion of the ink charge can be wasted as a result of the ink retention properties of the filler material. With fillerless writing instruments, most of the ink is usable and control of the usage is significantly better than with filler-type instruments.

There have been numerous attempts to manufacture a fillerless writing instrument. For example, U.S. Pat. No. 4,671,692 to Inaba discloses a writing pen having a flow-regulator having a labyrinth groove in its circumference interposed between a writing tip and an ink reservoir in a pen barrel in which an ink supply rod is inserted into the bore of the flow-regulator to guide ink to the writing tip. A body includes a labyrinth groove defined by a plurality of fins. A second ink supply rod made of porous material has a larger diameter than the first ink supply rod and guides ink to a third ink supply rod to thereby guide ink to the writing tip.

U.S. Pat. No. 4,382,707 to Anderka discloses a writing instrument having a single ink supply rod. This arrangement has several inherent disadvantages. For example, for an average sized writing instrument, the supply rod would necessarily be of significant length in order to feed ink directly from the ink reservoir to the writing point. To deliver ink to the writing point in specific amounts over such a great distance involves a loss of control and therefore may result in overfeeding or underfeeding the writing point with ink.

U.S. Pat. No. 4,239,408 to Mutschler discloses a writing instrument having an ink supply system having a flow controlling member, and an ink feeding member. The flow controlling member supplies ink from the reservoir to the ink feeding member. The ink feeding member supplies ink to the writing point. The flow controlling member has an effective flow section smaller than the flow section in the feeding member. Mutschler discloses a feed bar for venting ink having a spiral groove extending from the ink reservoir to an open orifice adjacent the point. However, the uniform nature of the groove does not provide structure to reduce the probability of excess ink entering the groove from flowing to the point.

The present invention relates to a writing instrument which avoids the above described disadvantages by providing first and second ink supply rods to provide a predetermined and consistent flow of ink as may be required. The writing instrument also incorporates structure to vent the ink supply to prevent the ink from leaking from the point of the writing instrument while enhancing the transport of ink with relative precision.

SUMMARY

A writing instrument is disclosed which includes a barrel defining an internal passage including an ink reservoir for containing a suitable ink supply. Preferably, the ink is a water-based ink. However, other inks such as solvent-based inks are contemplated. A venting mechanism is positioned at least partially within the internal passage of the barrel adjacent an anterior end portion thereof. The venting mechanism includes an elongated body defining an axial bore therethrough in communication with the ink reservoir, and a plurality of spaced apart fins peripherally surrounding and extending outwardly from the elongated body and defining a plurality of annular channels between the fins. Each of the fins defines a groove thereon to interconnect the annular channels. The writing instrument further includes a point support member supporting a writing point and positioned adjacent an anterior end portion of the venting mechanism and defining an axial bore aligned with the axial bore of the venting mechanism. A first ink supply rod is disposed within the axial bore of the venting mechanism and has a posterior end portion in communication with the ink reservoir to convey ink from the ink reservoir to an anterior portion of the venting mechanism. A second supply rod conveys ink from a posterior end portion disposed within the bore in the venting mechanism to an anterior end portion disposed within the bore of the point support member, to the writing point.

By providing only two ink supply rods, the number of rod interface junctions are reduced, thereby simplifying the assembly process of the instrument. Moreover, by reducing the number of rod interface junctions, the number of points of possible interruption to the ink flow is also reduced. Yet the provision of two rods provides the advantages of multiple ink supply rods, particularly in a fillerless-type writing instrument.

In addition, by providing at least two such ink supply rods, the rods can be individually structured and treated to optimize the flow at the various stages between the ink reservoir and the writing point. In particular, each rod can be extruded or molded as necessary to achieve a predetermined porosity and consequent ink flow. Thereafter, each rod may be selectively treated with a wetting agent to promote the flow of ink as it advances within the interstices of the rod, notably by capillary action. Such capillary action is actually enhanced by the contact of the "wave front" of the ink as it moves along the rod and progressively comes in contact with the wetting agent to cause it to move further under capillary action toward the writing point. Suitable air venting of the ink supply is provided by a circuitous air path between the writing tip portion and the reservoir.

In a preferred embodiment, the second ink supply rod has a cross-section of lesser dimension than the first supply rod. The fins define spaces therebetween which increases from a posterior end portion of the venting mechanism to an anterior end portion thereof. The internal passage of the barrel of the venting mechanism may be configured and dimensioned to receive an anterior end portion of the elongated body of the venting mechanism.

The first supply rod is preferably extruded or molded of polyester or polyacrylic material. The second supply rod is preferably extruded or molded of a fibrous material, such as polyester. In each instance, the method of fabrication of the rod and resultant porosity will be determined inter alia, by such factors as:

1) the viscosity and flow characteristics of the ink;

2) the length and diameter of the rod;

3) the wetting agent used on the rods; and 4) the amount of flow of ink to the writing point which is desired.

In a preferred embodiment, the point support member has a posterior end portion which is at least partially disposed within the axial bore of the venting mechanism. The posterior end portion of said point support member is constructed of a rigid material in order to support the second ink supply rod during manufacturing and use.

These and other features of the writing instrument will become more readily apparent to those skilled in the art from the following detailed description of preferred embodiments of the present invention.

BRIEF DESCRIPTION OF THE DRAWINGS

Preferred embodiments of the subject writing instrument are described hereinbelow with reference to the drawings wherein.

DETAILED DESCRIPTION OF PREFERRED EMBODIMENTS

Figure 1:
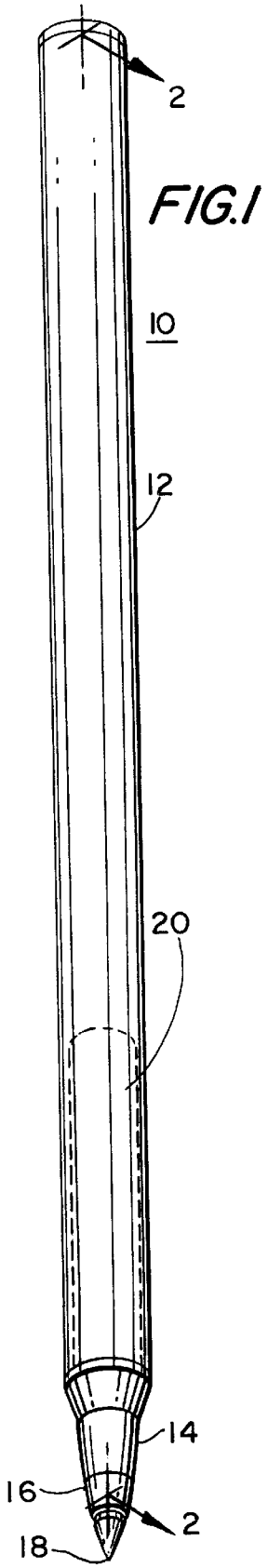
FIG. 1 is a perspective view of the writing instrument constructed in accordance with a preferred embodiment of the present invention.

In the drawings and in the description which follows, the term "anterior" will refer to the end of the writing instrument which is closest to the writing point, while the term "posterior" will refer to the end which is further from the writing point.

Referring now in detail to the drawings in which the reference numerals identify similar or identical elements, a first preferred embodiment of the subject writing instrument is illustrated in FIG. 1, and is designated generally by reference numeral 10. Writing instrument 10 includes barrel 12 and writing tip 14. Writing point support member 16 extends anteriorly from writing tip 14 and supports writing point 18 as shown. Venting mechanism 20 (illustrated generally in phantom lines in FIG. 1) is positioned within barrel 12 adjacent the anterior end portion thereof.

Figure 2:
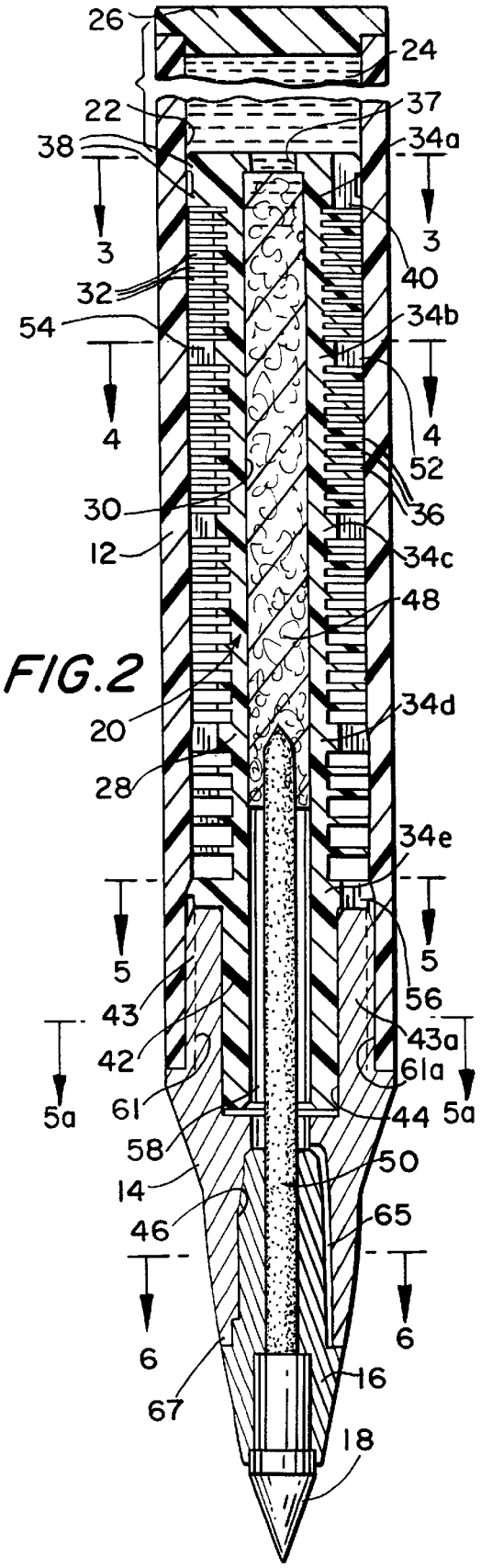
FIG. 2 is an enlarged longitudinal cross-sectional view of the writing instrument, taken along lines 2—2 of FIG. 1.

Referring to FIG. 2, there is illustrated in longitudinal cross-section, the components of the venting mechanism 20 of writing instrument 10. Barrel 12 defines elongated chamber 22 which includes ink reservoir 24 extending therethrough toward the posterior end portion. Ink reservoir 24 is integrally formed by chamber 22 and is positioned between the venting mechanism 20 at the anterior end portion, and the end cap 26 at the posterior end. Support body 28 extends longitudinally within venting mechanism 20 and includes a plurality of outwardly extending fins in the form of annular disc-like support rings 34*a*, 34*b*, 34*c*, 34*d* and 34*e* spaced apart from each other and extending circumferentially about the central support body 28 as shown in FIG. 2. Positioned between each adjacent pair of the annular support rings is a plurality of annular disc-like fins 32, spaced longitudinally from each other and extending in a similar fashion annularly around the support body. Each plurality of such fins 32 is selectively numbered and the numbers in each group differ from the next adjacent group. In particular, the number of fins 32 is greatest at the posterior end of the venting mechanism 20 and least at the anterior end of the venting mechanism 20, with the most anteriorly positioned group containing four fins.

Venting mechanism 20 is positioned within barrel 12 between ink reservoir 24 and writing tip 14. Venting mechanism 20, including support body 28 and disc-like fins 32, is preferably injection molded from ABS, polyacetal, nylon, or other engineering thermoplastics. Tubular body 28 defines an axial ink supply bore 30 extending longitudinally therethrough. As noted above, a plurality of spaced apart disc-like fins 32 and a plurality of thicker annular rings 34*a*, 34*b*, 34*c*, 34*d*, and 34*e* extend radially outwardly from, and circumferentially surround support body 28 and respectfully define a plurality of annular channels 36 therebetween. Annular rings 34*a*, 34*b*, 34*c*, 34*d*, and 34*e* are preferably formed monolithically with support body 28 and provide support for venting mechanism 20 with respect to barrel 12. As shown, disc-like fins 32 are positioned in groupings between rings 34*a*, 34*b*, 34*c*, 34*d*, and 34*e*. The longitudinal spacing between fins 32 increases from the posterior end of venting mechanism 20 to the anterior end thereof, i.e. the annular channels 36 increase in width from the posterior end to the anterior end of the venting mechanism 20. Aperture 37 is defined at the posterior end portion of venting mechanism 18. Aperture 37 is preferably of a lesser dimension than ink supply bore 30 and communicates with ink reservoir 24.

Cylindrical neck 42 extends from the anterior end of elongated body 28 and is received in bore 44 formed by a plurality of splines 43*a* in the posterior portion of writing tip 14 as will be described in further detail. Reception bore 44 communicates with axial chamber 46 which accommodates point support member 16. Axial chamber 46 communicates with axial ink supply bore 30 in venting mechanism 20.

Ink supply rod 48 is positioned within ink supply bore 30 and extends through tubular body 28. Ink supply rod 48 is preferably fabricated from an extruded or molded polyester or polyacrylic material. The posterior end of ink supply rod 48 is in communication with ink reservoir 24 through aperture 37 in tubular body 28. Although ink supply rod 48 may alternatively define a longitudinal bore to convey ink, preferably the rod 48 does not have a thru-bore and conveys ink through the bundle of fibers formed either by a molding or an extrusion process. Rod 48 is positioned at the anterior end portion of the instrument for reception of point connector rod 50, which is a fibrous rod that transports ink from ink supply rod 48 to writing point 18.

Point connector rod 50 is preferably made of extruded polyester fibers and has a smaller cross-sectional dimension as shown, than ink supply rod 48 and thereby a smaller ink capacity. The rod is preferably first extruded, then cut and ground at each end. The lesser dimension of point connector rod 50 permits writing tip 14 and point support 16 to be designed to comfortably fit in the user's hand while adequately supplying writing tip 14 with ink. The greater dimension of ink supply rod 48 permits sufficient ink to be transferred directly from ink reservoir 24 to connector rod 50 and thereby to point 18 than would be possible with a single narrow ink supply rod. Also, the larger cross-section of rod 48 allows rod 50 to be inserted into the anterior end of rod 48 and thus penetrate rod 48. This feature increases the resistance of the system to mechanical shock by the improved junction between rod 48 and rod 50.

Generally, the materials of ink supply rod 48 and point connector rod 50 will be selected in order to provide a consistent flow of ink to writing point 18, based upon the viscosity and capillary properties of the ink used in writing instrument 10. Polyester is preferred. However, alternatively, polyacrylic, polyacetal, polyethylene, polypropylene or nylon may be utilized. Either of the rods may either be extruded or sintered molded. In the extrusion process, the resinous material is heated sufficiently to be extruded as separate fibers, then partially cooled, and then caused to adhere to each other to form a bundle of fibers having ink passages extending therethrough. In the sintered molding process, the resinous material is placed in a mold and heated until it becomes tacky, but not molten. Thereafter, the material is cooled to form a generally porous rod in which a multiplicity of open interstices are formed to permit the passage of ink.

Figure 3:
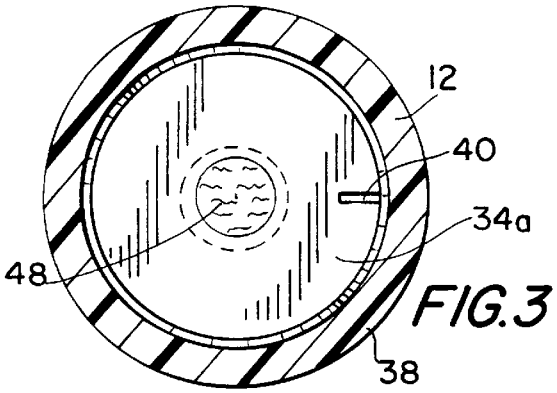
FIG. 3 is a transverse cross-sectional view of the writing instrument, taken along lines 3—3 of FIG. 2.

With further reference to FIG. 2 in conjunction with FIG. 3, posterior annular ring 34*a* defines a double peripheral seal 38 with the inner wall portion of barrel 12. Ink groove 40 is defined in posterior annular ring 34*a*, and extends from a posterior surface adjacent ink reservoir 24 to a posterior surface adjacent posteriormost aperture 37.

Figure 4:
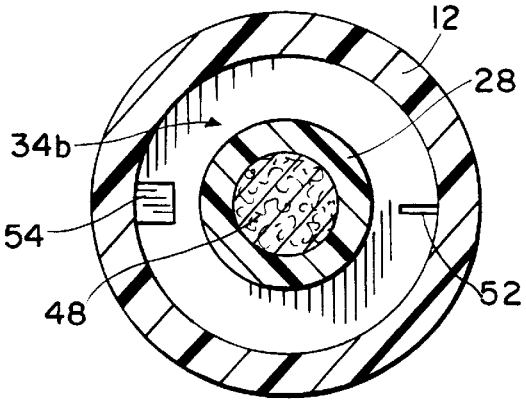
FIG. 4 is a transverse cross-sectional view of the writing instrument, taken along lines 4—4 of FIG. 2.

Referring now to FIG. 2 in conjunction with FIG. 4, each of the disc-like fins 32 and annular rings 34*b*, 34*c*, and 34*d* defines an ink groove 52 and an air groove 54 at opposite sides of the circumference. The system of air grooves as shown form a continuous and serpentine path which communicates the outside atmosphere with the ink supply without causing flow of ink into the air system. As shown, air groove 54 is greater in width than ink groove 52.

Figure 7:
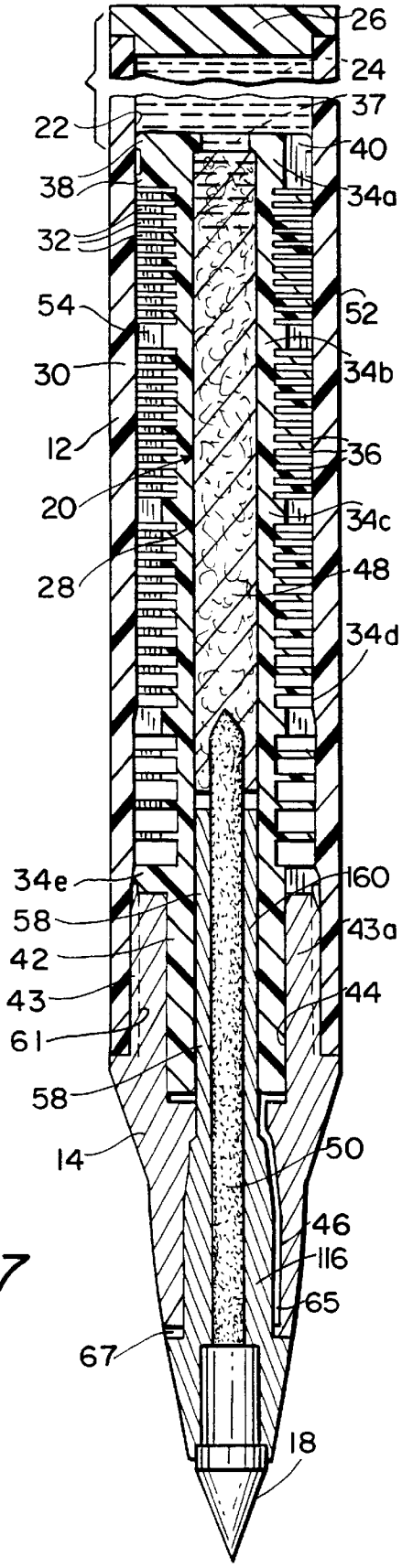
FIG. 7 is an enlarged longitudinal cross-sectional view similar to FIG. 1, of a writing instrument constructed in accordance with a second preferred embodiment.
Figure 5:
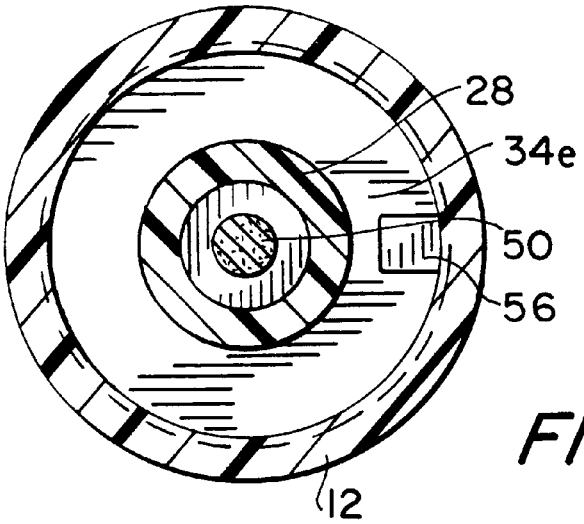
FIG. 5 is a transverse cross-sectional view of the writing instrument, taken along lines 5—5 of FIG. 2.
Figure 5A:
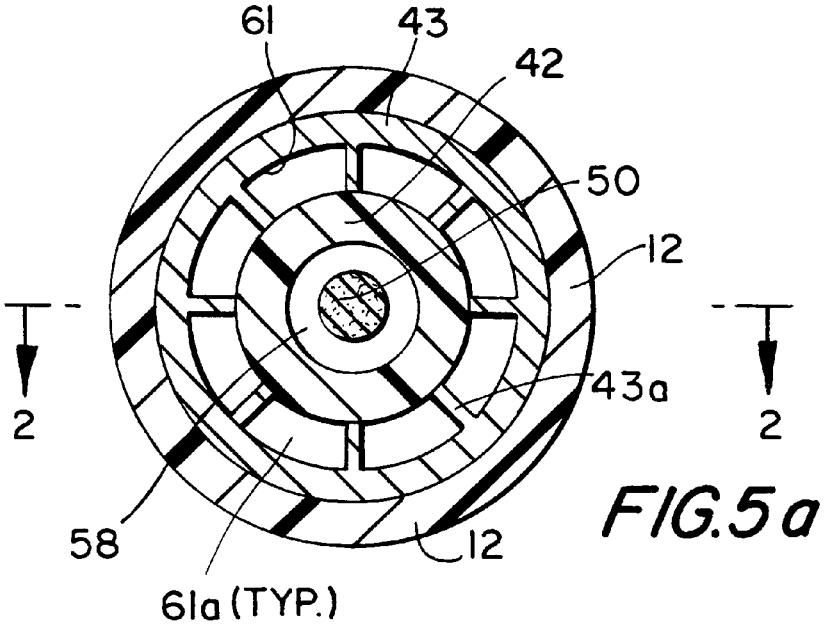
FIG. 5*a* is a transverse cross-sectional view of the writing instrument, taken along lines 5*a*—5*a* of FIG. 2.
Figure 6:
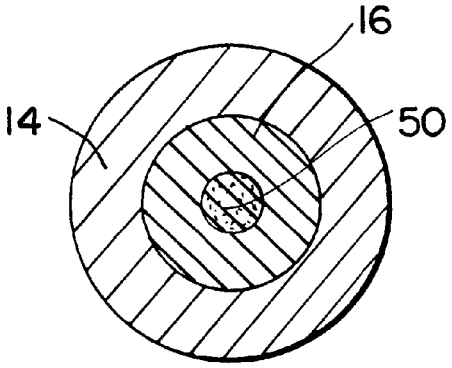
FIG. 6 is a transverse cross-sectional view of the writing instrument, taken along lines 6—6 of FIG. 2.

With reference to FIGS. 2 and 5 in conjunction with FIG. 5*a*, air groove 56 is formed at a peripheral portion of the anteriormost annular ring 34*e*. Air groove 56 in ring 34*e* is positioned in line with ink grooves 52 in rings 34*b*. Central opening 61 of cylindrical wall 43 defines an air gap between wall 43 and cylindrical neck 42 which is divided into a plurality of air passages 61*a* defined and positioned by and between a plurality of longitudinal splines 43*a* within central opening 61 as shown clearly in FIG. 5*a*. In FIGS. 2 and 7, the line of demarcation between cylindrical wall 43 and spline 43*a* is shown schematically by dashed lines on each side. Air passages 61*a* communicate with air slot 65 which in turn communicates via a slot (not shown) with vent hole 67 at a position 180° opposite slot 65. Rings 34*b* between section 4—4 and section 5—5 in FIG. 2 each have air slots 54 as shown in FIG. 4, while ring 34*e* below section 5-5 in FIG. 2 includes air slot 56 positioned 180° from air slots 54. Thus, a continuous but circuitous air path is defined from ink reservoir 24 to rings 34*a*, 34*b*, 34*c*, 34*d* and 34*e* to passages 61*a*, air slot 65 and finally to air slot 67 which communicates with the outside atmosphere. This circuitous passage permits air venting of the ink system while preventing ink from flowing freely out of the writing instrument. Lines 2—2 in FIG. 5*a* are shown to illustrate further the cross-section shown in FIG. 2.

Ink grooves 52 and air grooves 54 and 56 interconnect annular channels 36 such that ink may flow from ink reservoir 24 into venting mechanism 20 when a positive pressure is produced in ink reservoir 24 such as at elevated ambient temperatures. In addition, air may be introduced into venting mechanism 20 adjacent writing tip 14 via the circuitous path described above. More particularly, ink flow resulting from this increased pressure flows into ink groove 40 by capillary action and subsequently into posteriormost annular channel 36. Given sufficient pressure, ink will continue to flow through groove 52 towards the anterior portion of venting mechanism 20. The increase in spacing of fins 32 from the posterior end to the anterior end has the effect of reducing the probability of ink leakage from the ink reservoir 24 to the anterior end of venting mechanism 20 and the writing point 18 by initially filling the spaces at the posterior end.

In general, the writing instrument 10 of the present invention provides improved ink flow without vulnerability to shock, while providing a circuitous air path from the writing tip to the ink reservoir, to permit expansion and contraction of the ink system without loss of the requisite precise ink flow. In addition, by structuring two separate ink conductive rods as described, and by appropriate application of a wetting agent, the structure of the system as described permits the ink flow to the writing point with extreme precision, while providing the above-noted advantages.

Turning now to FIG. 7, there is illustrated a second preferred embodiment of the subject writing instrument, designated generally by reference numeral 100. Writing instrument 100 is constructed substantially as described above with respect to writing instrument 10, with the distinctions noted hereinbelow. In particular, point support member 116 has an elongated posterior support portion 160 which extends into air gap 58 defined between tubular body 28 and point connector rod 50. Posterior support portion 160 is preferably constructed of a rigid material, such as an engineering plastic. Posterior support portion 160 at least partially surrounds point connector rod 50 and prevents rod 50 from buckling during assembly of writing instrument 100 as well as during normal use thereof. Air venting is provided by slot 65 which communicates with air passages 61*a* as in the embodiment shown in FIG. 2. Thereafter, air venting is identical to the embodiment of FIG. 2. Thus with the structure as described, the writing instrument includes a point connector rod of relatively narrow cross-sectional dimension, yet having an anterior portion which supports the writing point with substantial strength and rigidity. This feature makes it possible to reduce the outer anterior dimension of the instrument sufficiently, to accommodate the user's grip thus enhancing the ergonomic character of the instrument. In all other respects, the embodiment of FIG. 7 is identical to the embodiment of FIG. 2.

It will be understood that various modifications may be made to the embodiments disclosed herein. Therefore, the above description should not be construed as limiting, but merely as exemplifications of preferred embodiments. Those skilled in the art will envision other modifications within the scope and spirit of the claims appended hereto.

What is claimed is:

1. A writing instrument, which comprises:

a) a barrel defining an internal passage including an ink reservoir;

b) a venting mechanism positioned at least partially within said internal passage of said barrel adjacent an anterior end portion thereof, said venting mechanism including:

i) an elongated body defining an axial bore therethrough in communication with said ink reservoir; and ii) a plurality of spaced apart fins peripherally surrounding and extending outwardly from said elongated body and defining a plurality of annular channels between said fins, said fins defining a groove thereon to interconnect said annular channels;

c) a point support member supporting a writing point and positioned adjacent an anterior end portion of said venting mechanism and defining an axial bore aligned with said axial bore of said venting mechanism;

d) a first ink supply rod disposed within said axial bore of said venting mechanism and having a posterior end portion in direct communication with said ink reservoir to convey ink from said ink reservoir to an anterior end portion thereof, said first supply rod extending from said ink reservoir to a location at least approximately one half the distance between said ink reservoir and said writing point; and e) a second ink supply rod in direct contact with an anterior end portion of said first ink supply rod for conveying ink from a posterior end portion to said writing point, said second ink supply rod having a cross-sectional area less than the cross-sectional area of said first ink supply rod and being disposed within said bore of said venting mechanism and extending from said anterior end portion of said first ink supply rod to an anterior end portion there of disposed within said bore of said point support member so as to contact said writing point.

2. The writing instrument as recited in claim 1, wherein said spaced apart fins define spaces which increase from a posterior end portion of said venting mechanism to an anterior end portion thereof.

3. The writing instrument as recited in claim 2, wherein said internal passage of said barrel is configured and dimensioned to receive an anterior end portion of said elongated body of said venting mechanism.

4. The writing instrument as recited in claim 1, wherein said first supply rod is extruded for molded from a material selected from the group consisting of polyester, polyacrylic, polyacetal, polyethylene, polypropylene and nylon.

5. The writing instrument as recited in claim 1, wherein said second supply rod is extruded from a material selected from the group consisting of polyacetal, polyethylene, polypropylene, polyester, polyacrylic and nylon.

6. The writing instrument as recited in claim 1, wherein said first supply rod is molded from a material selected from the group consisting of polyester, polyacrylic, polyacetal, polyethylene, polypropylene and nylon.

7. The writing instrument as recited in claim 1, wherein said second supply rod is molded from a material selected from the group consisting of polyacetal, polyethylene, polypropylene, polyester, polyacrylic and nylon.

8. A writing instrument, which comprises:

a) a barrel defining an internal passage including an ink reservoir;

b) a venting mechanism positioned at least partially within said internal passage of said barrel adjacent an anterior end portion thereof, said venting mechanism including:

i) an elongated body defining an axial bore therethrough in communication with said ink reservoir; and ii) a plurality of spaced apart disc-like fins peripherally surrounding and extending outwardly from said elongated body and defining a plurality of annular channels between said fins, each of said fins defining a groove thereon to interconnect said annular channels;

c) a point support member supporting a writing point and having a posterior end portion extending at least partially within said axial bore of said venting mechanism so as to be supported thereby, said point support member defining an axial bore aligned with said axial bore of said venting mechanism;

d) a first ink supply rod disposed within said axial bore of said venting mechanism and having a posterior end portion in direct communication with said ink reservoir to convey ink from said ink reservoir to an anterior end portion thereof, said first ink supply rod extending from said ink reservoir to a location at least approximately one half the distance between said ink reservoir and said writing point; and e) a second ink supply rod disposed within said bore of said venting mechanism and in direct contact with said first ink supply rod for conveying ink from a posterior end portion to an anterior end portion in contact with said writing point said second ink supply rod having a cross-sectional dimension less than the cross-sectional dimension of said first ink supply rod, and extending from said anterior end portion of said first ink supply rod to said point support member and to said writing point.

9. The writing instrument as recited in claim 8, wherein said posterior end portion of said point support member is constructed of a rigid material.

10. The writing instrument as recited in claim 9, wherein said spaced apart fins define spaces therebetween which increase from a posterior end portion of said venting mechanism to an anterior end portion thereof.

11. The writing instrument as recited in claim 8, wherein said first supply rod is extruded from a material selected from the group consisting of polyester, polyacrylic, polyacetal, polyethylene, polypropylene and nylon.

12. The writing instrument as recited in claim 8, wherein said second supply rod is extruded from a material selected from the group consisting of polyacetal, polyethylene, polypropylene, polyester, polyacrylic and nylon.

13. The writing instrument as recited in claim 8, wherein said venting mechanism further comprises:

a seal disposed at a posterior end portion of said venting mechanism between said barrel and a posterior-most fin, said posterior-most fin defining a groove between said ink reservoir and said annular channels.

14. The writing instrument as recited in claim 8, wherein said first supply rod is molded from a material selected from the group consisting of polyester, polyacrylic, polyacetal, polyethylene, polypropylene and nylon.

15. The writing instrument as recited in claim 8, wherein said second supply rod is molded from a material selected from the group consisting of polyacetal, polyethylene, polypropylene, polyester, polyacrylic and nylon.

16. A writing instrument, which comprises:

a) a barrel defining an internal passage including an ink reservoir;

b) a venting mechanism positioned at least partially within said internal passage of said barrel adjacent an anterior end portion thereof, said venting mechanism including:

i) an elongated body defining an axial bore therethrough in communication with said ink reservoir;

ii) a plurality of spaced apart disc-like fins peripherally surrounding said elongated body and defining a plurality of annular channels between said fins, each of said fins defining a groove thereon to interconnect said annular channels; and iii) a seal disposed at a posterior portion of the venting mechanism between said barrel and a posterior-most fin, said posterior-most fin defining a groove between said ink reservoir and said annular channel;

c) a point support member supporting a writing point and positioned adjacent an anterior end portion of said venting mechanism and defining an axial bore aligned with said axial bore of said venting mechanism;

d) a first ink supply rod disposed within said axial bore of said venting mechanism and having a posterior end portion in direct communication with said ink reservoir to convey ink from said ink reservoir to an anterior end portion thereof, said first ink supply rod extending from said ink reservoir to a location at least approximately one half the distance between said ink reservoir and said writing point; and e) a second ink supply rod disposed within said bore of said venting mechanism and in direct contact with an anterior end portion of said first ink supply rod for conveying ink from a posterior end portion thereof to an anterior end portion thereof disposed within said bore of said point support member, to and in direct contact with said writing point.

17.The writing instrument as recited in claim 16, wherein said second supply rod has a cross-section of lesser dimension than said first supply rod.

18. The writing instrument as recited in claim 17, wherein said spaced apart fins define a spacing between said fins which increases from a posterior end portion of said venting mechanism to an anterior end portion thereof.

19. The writing instrument as recited in claim 18, wherein said axial bore is configured and dimensioned to receive an anterior end portion of said elongated body of said venting mechanism.

20. The writing instrument as recited in claim 16, wherein said first supply rod is from a material selected from the group consisting of polyester, polyacrylic, polyacetal, polyethylene, polypropylene and nylon.

21. The writing instrument as recited in claim 16, wherein said second supply rod extruded from a material selected from the group consisting of polyacetal, polyethylene, polypropylene, polyester, polyacrylic and nylon.

22. The writing instrument as recited in claim 16, wherein said first supply rod is molded from a material selected from the group consisting of polyester, polyacrylic, polyacetal, polyethylene, polypropylene and nylon.

23. The writing instrument as recited in claim 16, wherein said second supply rod is molded from a material selected from the group consisting of polyacetal, polyethylene, polypropylene, polyester, polyacrylic and nylon.

24. A writing instrument, which comprises:

a) a barrel defining an internal passage including an ink reservoir;

b) a venting mechanism positioned at least partially within said internal passage of said barrel adjacent an anterior end portion thereof, said venting mechanism including:

i) an elongated body defining an axial bore therethrough in communication with said ink reservoir;

ii) a plurality of spaced apart disc-like fins peripherally surrounding said elongated body and defining a plurality of annular channels between said fins, each of said fins defining an ink and an air groove thereon to interconnect said annular channels;

iii) a seal disposed at a posterior portion of the venting mechanism between said barrel and a posterior-most fin, said posterior-most fin defining a groove between said ink reservoir and said annular channel; and iv) means to permit air venting of said ink reservoir.

c) a point support member supporting a writing point and positioned adjacent an anterior end portion of said venting mechanism and defining an axial bore aligned with said axial bore of said venting mechanism;

d) a first ink supply rod disposed within said axial bore of said venting mechanism and having a posterior end portion in direct communication with said ink reservoir to convey ink from said ink reservoir to an anterior end portion thereof, said first ink supply rod extending from said ink reservoir to a location at least approximately one half the distance between said ink reservoir and said writing point; and e) a second supply rod disposed within said bore of said venting mechanism and in direct contact with said first ink supply rod for conveying ink from a posterior end portion to an anterior end portion thereof, said second ink supply rod having a cross-sectional area less than the cross-sectional area of said first ink supply rod and being disposed within said bore of said point support member and in direct contact with said writing point, said point support member extending into said internal passage of said barrel to a location at least equal to about one half the length of said second ink supply rod so as to provide support for said anterior end portion of said venting mechanism and said anterior end portion of second ink supply rod.

25. The writing instrument as recited in claim 24, wherein said ink reservoir air venting means defines a circuitous air path between said ink reservoir and the outside atmosphere.

26. The writing instrument as recited in claim 25, wherein said circuitous path extends from said ink reservoir to said posterior end portion adjacent said writing point.

* * * * *